US007267575B1

(12) United States Patent
Hwang

(10) Patent No.: US 7,267,575 B1
(45) Date of Patent: Sep. 11, 2007

(54) STRUCTURE OF SIGNAL CABLE CONNECTOR

(75) Inventor: Mao-Lin Hwang, Chung Ho (TW)

(73) Assignee: Uniconn Corp., Taipei Hsien (TW)

( * ) Notice: Subject to any disclaimer, the term of this patent is extended or adjusted under 35 U.S.C. 154(b) by 0 days.

(21) Appl. No.: 11/672,149

(22) Filed: Feb. 7, 2007

(51) Int. Cl.
*H01R 12/24* (2006.01)

(52) U.S. Cl. ..... 439/497; 439/607

(58) Field of Classification Search ..... 439/497, 439/607, 494, 496, 499
See application file for complete search history.

(56) References Cited

U.S. PATENT DOCUMENTS 6,139,365 A * 10/2000 Lok ..... 439/607
6,380,485 B1 * 4/2002 Beaman et al. ..... 174/88 R
6,672,905 B2 * 1/2004 Tharp et al. ..... 439/660
6,705,893 B1 * 3/2004 Ko ..... 439/607

* cited by examiner

*Primary Examiner*—Hae Moon Hyeon
(74) *Attorney, Agent, or Firm*—Rabin & Berdo. P.C.

(57) ABSTRACT

A structure of signal cable connector, which is connected to the signal cable between the hard disk and the computer's main board, comprises at least an enclosure, a circuit board and a wire strand. Wherein a wire block is utilized to affix the signal wires and a ground block to conduct the soldered ground wires so as to minimize the solder points incurred by direct solder of conducting wires on circuit board, resulting in easier assembly and optimized yield.

6 Claims, 5 Drawing Sheets

STRUCTURE OF SIGNAL CABLE CONNECTOR

BACKGROUND OF THE INVENTION

I. Field of the Invention

The present invention relates to a structure of signal cable connector, particularly to a structure of round ribbon cable connector that is connected to the round ribbon cable connecting the hard disk and the computer's main board. The present invention provides separate structures of wire block and ground block to facilitate the assembly and optimize the yield.

II. Description of the Prior Art

The signal cable of the prior art, which is utilized to connect the hard disk and the computer's main board, is a ribbon cable with many conducting wires running parallel to each other on the same flat plane. As a result the ribbon cable is wide, flat and oriented in such a way that can hardly be sharply twisted for connection. Also, more space is required to accommodate the excess of ribbon cable. To have less bulky cable and even greater airflow, the round ribbon cable, which is more manageable and far easier to install than the ribbon cable of the prior art, is introduced.

However, the round ribbon cable of the prior art as shown in FIG. 5 may be brought nearer to perfection with an innovative connector. The structure of round ribbon cable connector mainly comprises an enclosure51, a circuit board52 and a wire strand53. Wherein the conducting wires531 of the wire strand53 including ground wires and signal wires are all gathered to be directly soldered at one end on face and back surfaces of the circuit board52. After soldering, an enclosure51 is injection molded on connection portion of said wire strand53 and circuit board52. Generally, the ribbon cable of the prior art comprises at least 26 pins, which are to be soldered on a circuit board52 of very compacted dimensions. As a result those pins must be closely crowded together on the circuit board52. No doubt, solder of many tiny pins on a compact surface that easily causes short circuit is quite a challenge. In addition, while the wire strand 53 is connected to the circuit board52, the conducting wires cannot be well affixed that would cause stiff challenge in wire stripping, soldering and wire connection. Consequently, it is hard to advantage the yield. Furthermore, the enclosure51, which is directly injection molded on connection portion of the wire strand53 and the circuit board52, cannot be demounted for repair and replacement when the round ribbon cable is subject to defect. Under the circumstances, no other choice but to scrap the round ribbon cable subject to defect, resulting in excessive expenditure.

SUMMARY OF THE INVENTION

In view of the foregoing drawbacks, the present invention aims at providing an innovative "structure of signal cable connector".

Main objective of the present invention is to provide a simple structure of signal cable connector that may facilitate the assembly and the solder as well as optimize the product stability.

The secondary objective of the present invention is to provide a demountable structure of signal cable connector constructed with a die-casting two-piece metal enclosure or an injection molded one-piece plastic enclosure that can sleeve the circuit board with soldered conducting wires.

To achieve the foregoing objectives, the present invention provides the signal cable between the hard disk and the computer's main board with a structure of signal cable connector that comprises at least an enclosure, a circuit board and a wire strand. The characteristic lies in: there are a wire block and a ground block at solder end of the wire strand. The wire block is composed by a pair of conjugate plastic blocks where a plurality of furrows running lengthwise are formed on the surface, a plurality of ridges are formed around front and rear openings, and a plurality of grooves are incised from said ridges. The ground block composed by a pair of conjugate metal blocks comprises a pair of mortise and tenon and a fork protruding forwardly. For assembly, firstly, fitting conducting wires of the wire strand into furrows of the plastic blocks respectively, and concealing said pair of plastic blocks under a pair of metal blocks so as to become one block unit, and utilizing the forks on flanks of the metal block to hold the ground wires for being soldered on ground circuits on two sides of the circuit board; secondly, soldering the signal wires of the wire strand on signal circuits of the circuit board, and folding the ground wires of the wire strand for being fitted into grooves so as to be soldered on ground block.

According to the foregoing assembly, fitting conducting wires of the wire strand into furrows of the plastic blocks, and then concealing said plastic blocks under the metal blocks so as to form into one block unit; further, stripping said conducting wires of the wire strand, which are well aligned and affixed on wire block, by laser cutting so as to optimize the yield while minimizing the operation time. After wire stripping, soldering the ground wires on ground circuits on two sides of the circuit board. The plastic blocks are well concealed under the metal blocks by forks on flanks of said metal blocks. And, the circuit board is thus well fitted in the plastic blocks that are concealed under the metal blocks. In another word, a sub-assembly unit is formed after fitting the circuit board comprising ground circuits into plastic blocks, and concealing said plastic blocks under metal blocks. Later on, soldering the signal wires on signal circuits of the circuit board, and folding the ground wires so as to be fitted into grooves of the wire block and soldered on ground block. The ground wires are conducted via forks on flanks of the ground block to ground circuit of the circuit board. Finally, said circuit board, ground block and wire strand are wrapped up with insulation material so as to be sleeved into the injection molded enclosure, turning all the components and sub-assembly into a final assembly.

Accordingly, the present invention offers a structure of signal cable connector that possesses advantages of easy assembly, optimized yield and cost effectiveness: direct solder on the circuit board drastically reduces quantity of the circuits (only signal wires and ground wires on two sides) and maximizes space between signal circuits that optimize the yield while facilitating the assembly. In addition, the demountable structure achieves in facilitating repair and replacement of the components inside the enclosure, resulting in optimal cost effectiveness.

DESCRIPTION OF THE PREFERRED EMBODIMENTS

Desirable structure, assembly and features of the present invention will be better understood from the detailed description and drawings that follow, in which various embodiments of the disclosed invention are illustrated by way of example.

Figure 1:
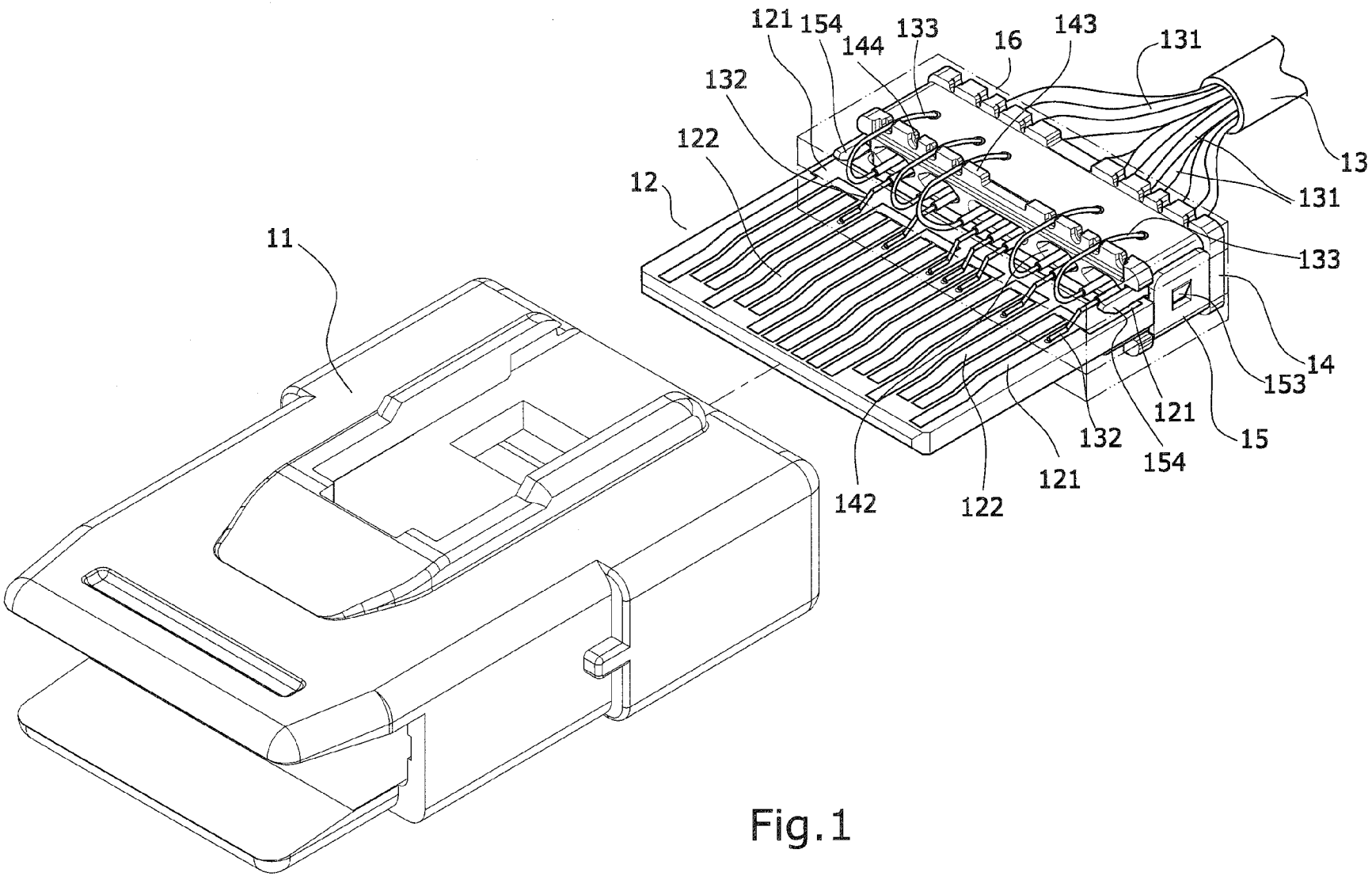
FIG. 1 is a three-dimensional view showing assembly of an embodiment of the invention.
Figure 2:
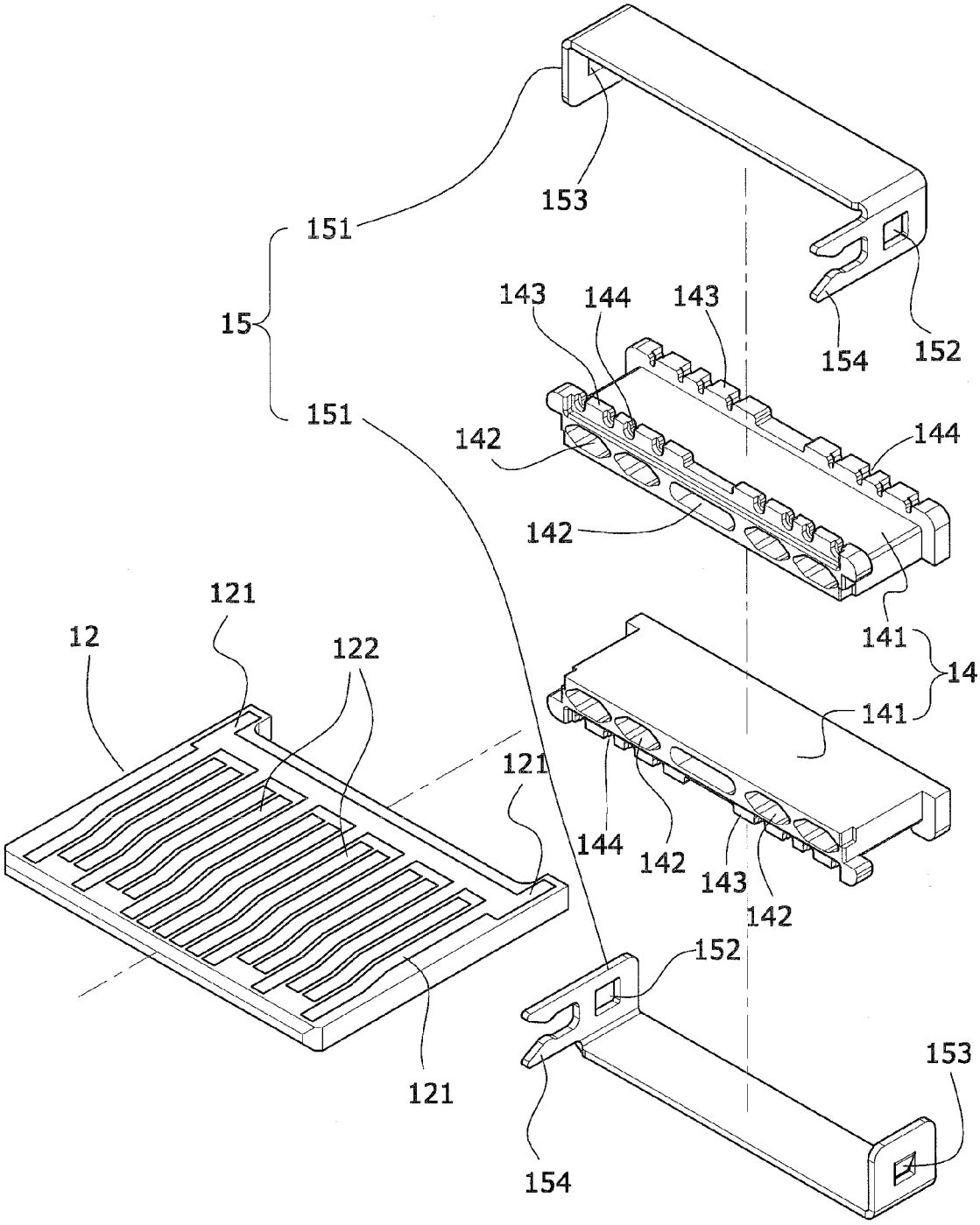
FIG. 2 is a three-dimensional view showing exploded diagram of the invention.

As shown in FIGS. 1 and 2, the "structure of signal cable connector" mainly comprises an enclosure11, a circuit board12 and a wire strand13 so as to be connected to the signal cable between the hard disk and the computer's main board. The characteristic lies in: there are a wire block14 and a ground block15 at solder end of the wire strand13; the wire block14 is composed by a pair of conjugate plastic blocks141 where a plurality of furrows142 running lengthwise are formed on the surface, a plurality of ridges143 are formed around front and rear openings, and a plurality of grooves incised from said ridges; the ground block15 is composed by a pair of conjugate metal blocks151 comprising a pair of mortise152 and tenon153 and a fork154 protruding forwardly. For assembly, firstly, fitting conducting wires131 of the wire strand13 into furrows142 of the plastic blocks141 respectively, and concealing said pair of plastic blocks141 under a pair of metal blocks151 so as to become one block unit, and utilizing the forks154 on flanks of the metal block151 to hold the ground wires for being soldered on ground circuits121 on two sides of the circuit board12; secondly, soldering the signal wires132 from conducting wires131 of the wire strand on signal circuits 122 of the circuit board12, and folding the ground wires133 from conducting wires131 of the wire strand for being fitted into grooves144 so as to be soldered on ground block15.

Figure 3:
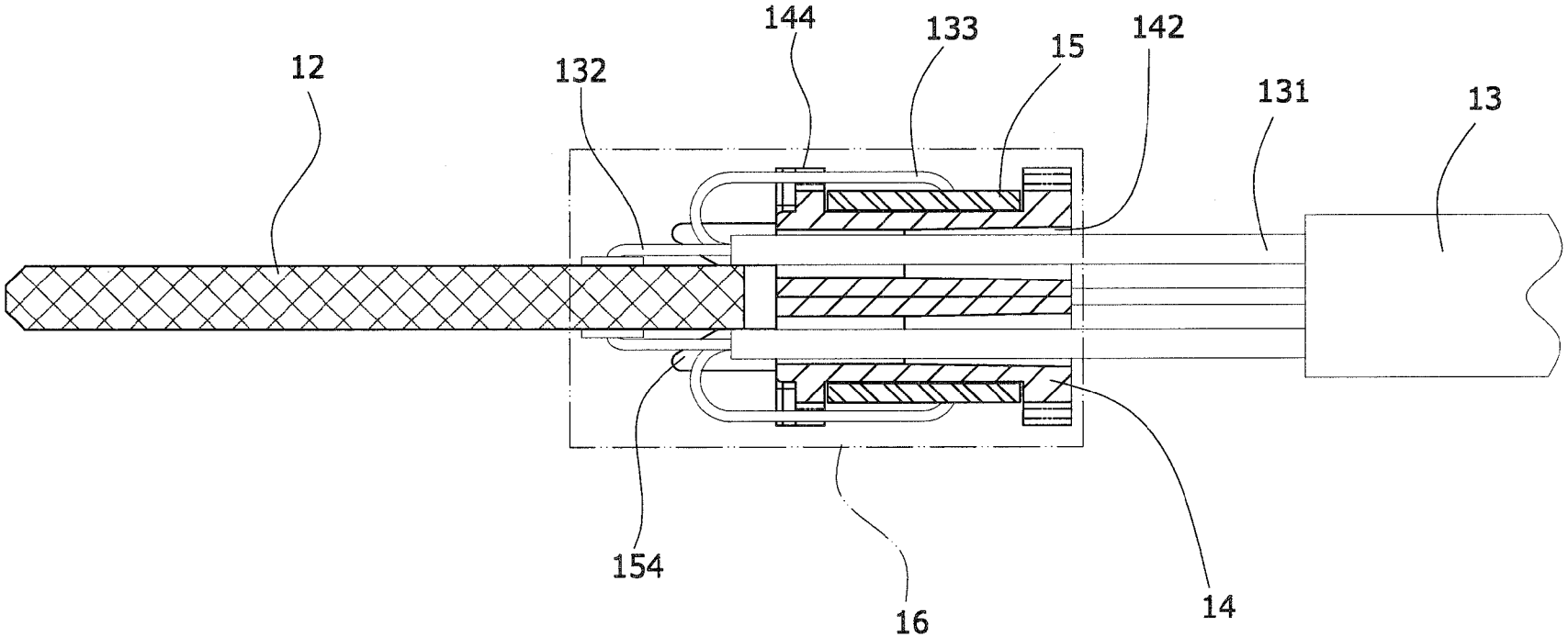
FIG. 3 is a sectional view of assembly of the invention.

According to the foregoing assembly shown in FIGS. 1 and 3, fitting conducting wires131 of the wire strand13 into furrows142 of the plastic blocks141, and then concealing said plastic blocks under the metal blocks151 so as to form into one block unit; further, stripping conducting wires of the wire strand 13, which are well aligned and affixed on wire block14, by laser cutting so as to optimize the yield while minimizing the operation time. After wire stripping, soldering the ground wires on ground circuits121 on two sides of the circuit board12. The plastic blocks are well concealed under the metal blocks15 by the forks154 on flanks of said metal blocks15. And, the circuit board12 is thus well fitted in the plastic blocks that are concealed under the metal blocks. In another word, a sub-assembly unit is formed by fitting said circuit board comprising ground circuits into plastic blocks, and concealing plastic blocks under metal blocks. Later on, soldering the signal wires132 on signal circuits122 of the circuit board12, and folding the ground wires133 so as to be fitted into grooves144 of the wire block14 and soldered on ground block15. The ground wires133 are conducted via forks154 on flanks of the ground block15 to ground circuit121 of the circuit board12. Finally, rounding up the circuit board12, ground block15 and wire strand13 with insulation material16 (illustrated by dotted line in FIG. 1) so as to be sleeved into the injection molded enclosure11, turning all the components and sub-assembly into a final assembly.

Accordingly, the present invention offers a structure of signal cable connector that possesses advantages of easy assembly, optimized yield and cost effectiveness. Direct solder on the circuit board12 drastically reduces quantity of circuits (only signal wires and ground wires on two sides) and maximizes space between signal circuits122 that optimize the yield while facilitating the assembly. In addition, when the connector is subject to any defect after assembly, the enclosure11 can be demounted for repair and replacement of the components inside, resulting in cost effectiveness.

Figure 4:
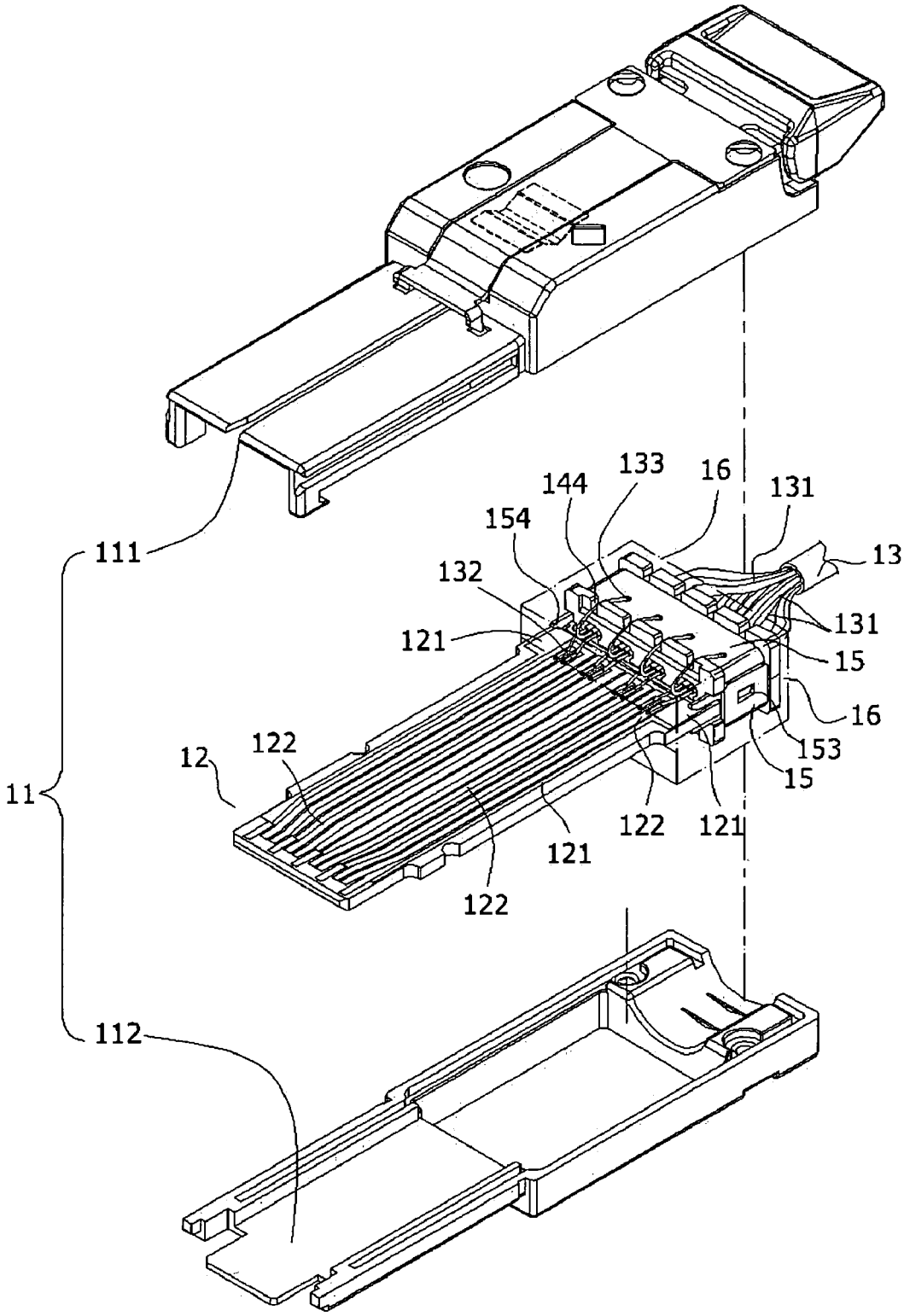
FIG. 4 is sectional view of another embodiment of the invention.
Figure 5:
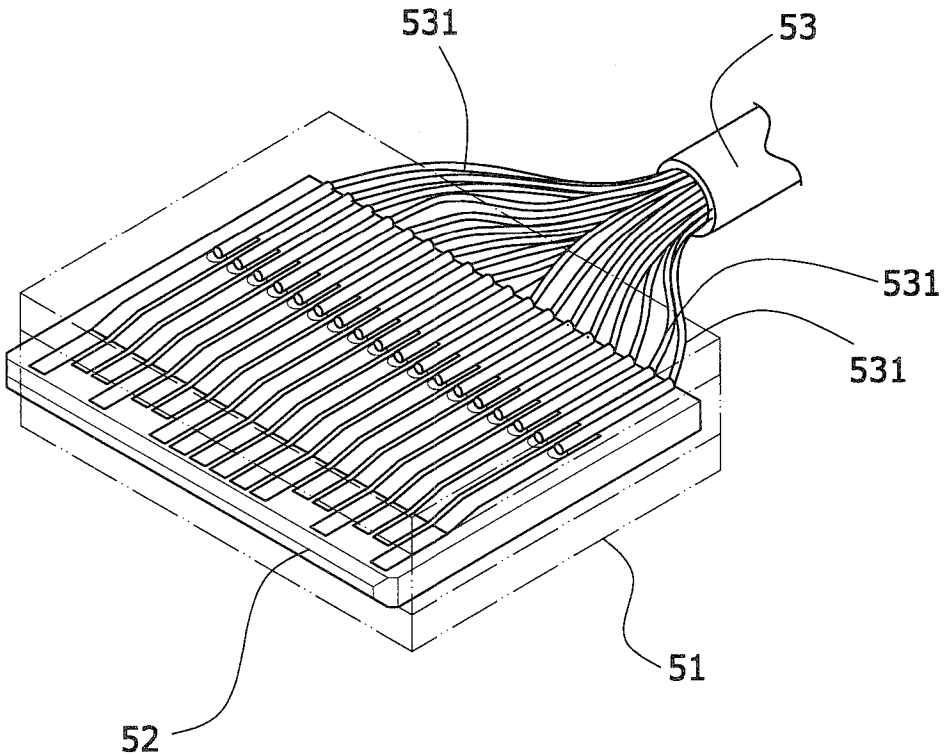
Fig.5 (Prior Art)
FIG. 5 is a three-dimensional view showing exploded diagram of the prior art.

With reference to FIG. 4, which shows another embodiment of the present invention, the structure of signal cable connector comprises at least an enclosure11, a circuit board12 and a wire strand13. The enclosure11 hereby, which comprises an upper unit111 and a lower unit112, is made of metal such as zinc and shaped by die-casting whereas enclsoure11 of the embodiment shown by FIG. 1 is made of plastic and shaped by injection mold. However, the wire block14 and the ground block15 are identical to those of the embodiment shown by FIG. 1. The wire block14 is composed by a pair of conjugate plastic blocks141 where a plurality of furrows142 running lengthwise are formed on the surface, a plurality of ridges143 are formed around front and rear openings, and a plurality of grooves144 are incised from said ridges143. The ground block15 composed by a pair of conjugate metal blocks151 comprises a pair of mortise152 and tenon153 and a fork154 protruding forwardly. After the wire strand13 is connected to the circuit board12, the connection portion is rounded up with insulation material16 so as to be sleeved into wire block, between its upper unit111 and lower unit112. Assembly like such facilitates the assembly and solder as well as optimizes product stability and cost effectiveness.

While the present invention is susceptible to various modifications and alternative forms, two specific embodiments have been shown by way of example in the drawings and described in detail herein. However, it should be understood that the invention is not intended to be limited to the particular form disclosed. Rather, the invention is to cover all modifications, equivalents, and alternatives falling within the spirit and scope of the invention as defined by the appended claims.

To sum up, the "structure of signal cable connector" of the present invention do possesses the practicability and the advancement of the industry as it achieves in facilitating the assembly and solder as well as optimizing the product stability and cost effectiveness.

What is claimed is:

1. A structure of signal cable connector, which is connected to a signal cable between a hard disk and a computer's main board, comprises:

an enclosure;

a circuit board;

a wire strand;

a wire block, which is composed of a pair of conjugate plastic blocks, installed at a solder end of the wire strand; and said pair of conjugate plastic blocks comprise a plurality of furrows running lengthwise, two ridges around front and rear openings thereof as well as a plurality of grooves incised into said ridges;

a ground block composed of a pair of conjugate metal blocks that comprise a pair of mortise and tenon and a fork protruding forwardly; conducting wires of the wire strand fitted into furrows of the plastic blocks respectively, and said plastic blocks being concealed under the pair of metal blocks so as to constitute one block unit, and the forks on flanks of the metal block electrically coupling the ground wires to ground circuits on two sides of the circuit board; signal wires of the wire strand being soldered on signal circuits of the circuit board, and the ground wires of the wire strand being folded to fit into the grooves so as to be soldered on the ground block.

2. The structure of signal cable connector of claim 1, wherein the solder end of the circuit board and wire strand are composed of and held by the wire block, the ground block, and an insulation material, and wherein the solder ends of wire strand, circuit board and ground block are wrapped up with the insulation material after soldering.

3. The structure of signal cable connector of claim 1, wherein the enclosure is a one-piece unit made of plastic and shaped by injection mold.

4. The structure of signal cable connector of claim 1, wherein the enclosure is a two-piece unit comprising upper and lower units, made of metal and shaped by die-casting.

5. The structure of signal cable connector of claim 2, wherein the enclosure is a one-piece unit made of plastic and shaped by injection mold.

6. The structure of signal cable connector of claim 2, wherein the enclosure is a two-piece unit comprising upper and lower units, made of metal and shaped by die-casting.

* * * * *